US008677688B2

(12) United States Patent
Skibinski et al.

(10) Patent No.: US 8,677,688 B2
(45) Date of Patent: Mar. 25, 2014

(54) MULTISEAL DOOR, METHOD FOR SEALING AN ENCLOSURE

(75) Inventors: Jerry W. Skibinski, Bloomingdale, IL (US); Stanley J. Zielinski, Glendale Heights, IL (US); Saulis Gugis, Naperville, IL (US); Joseph C. Weibler, West Chicago, IL (US)

(73) Assignee: ETS-Lindgren Inc., Wood Dale, IL (US)

( * ) Notice: Subject to any disclaimer, the term of this patent is extended or adjusted under 35 U.S.C. 154(b) by 489 days.

(21) Appl. No.: 12/783,410

(22) Filed: May 19, 2010
(Under 37 CFR 1.47)

(65) Prior Publication Data

US 2011/0126463 A1 Jun. 2, 2011

Related U.S. Application Data

(60) Provisional application No. 61/179,662, filed on May 19, 2009.

(51) Int. Cl.
*E06B 7/16* (2006.01)
*E06B 3/38* (2006.01)
*E06B 7/00* (2006.01)

(52) U.S. Cl.
USPC ..... 49/125; 49/501

(58) Field of Classification Search
USPC ..... 49/125, 127, 128–130, 475.1, 498.1, 49/501
See application file for complete search history.

(56) References Cited

U.S. PATENT DOCUMENTS 3,256,384 A * 6/1966 Lindgren ..... 174/367
3,504,095 A * 3/1970 Roberson et al. ..... 174/355
3,507,974 A * 4/1970 Roster et al. ..... 174/367
3,589,070 A * 6/1971 Hansen ..... 49/483.1
3,774,522 A * 11/1973 Marsh ..... 454/187
4,069,618 A * 1/1978 Geiss ..... 49/483.1
4,115,953 A * 9/1978 Brosenius ..... 49/125
4,149,615 A * 4/1979 Kappenhagen ..... 187/324
4,180,942 A * 1/1980 Saucier ..... 49/125
4,192,100 A * 3/1980 Klema ..... 49/404
4,370,831 A * 2/1983 Hamilton ..... 49/477.1
4,503,837 A * 3/1985 Smith et al. ..... 126/190
4,746,765 A * 5/1988 Mallott ..... 174/368
4,910,920 A * 3/1990 Nichols ..... 49/484.1
4,929,802 A * 5/1990 Schaepers et al. ..... 174/368
5,017,736 A * 5/1991 Yarger et al. ..... 174/364
5,043,528 A * 8/1991 Mohr ..... 174/355
5,197,225 A * 3/1993 Yff ..... 49/223
5,224,296 A * 7/1993 Brignon ..... 49/130
5,452,550 A * 9/1995 Vanesky et al. ..... 52/173.1
5,534,662 A * 7/1996 Peacock et al. ..... 174/355
5,569,878 A * 10/1996 Zielinski ..... 174/364
5,736,671 A * 4/1998 Perala et al. ..... 174/365
6,170,203 B1 * 1/2001 Schlapfer ..... 52/173.1
6,294,729 B1 * 9/2001 Kaplo ..... 174/371
6,519,899 B1 * 2/2003 Hurzeler ..... 49/501
6,534,706 B1 * 3/2003 Rapp et al. ..... 174/354
6,914,184 B1 * 7/2005 Lahita ..... 174/374
7,117,640 B2 * 10/2006 Hurzeler ..... 49/501
7,246,681 B2 * 7/2007 Christen ..... 181/285
7,491,898 B2 * 2/2009 Villanella ..... 174/368
7,568,311 B2 * 8/2009 Shivak et al. ..... 49/409
7,750,251 B2 * 7/2010 Loughry et al. ..... 174/382
7,757,437 B2 * 7/2010 Schulte et al. ..... 49/141
8,043,098 B2 * 10/2011 Huang ..... 439/95
8,176,682 B2 * 5/2012 Gaviglia ..... 49/501
8,375,645 B2 * 2/2013 Iwauchi et al. ..... 52/29
2004/0049984 A1 * 3/2004 Pfaff ..... 49/116
2005/0150169 A1 * 7/2005 Schulte et al. ..... 49/410
2007/0151156 A1 * 7/2007 Thielmann ..... 49/125
2011/0072724 A1 * 3/2011 Scruggs ..... 49/129
2011/0214350 A1 * 9/2011 Salvietti et al. ..... 49/129

* cited by examiner

*Primary Examiner* — Katherine Mitchell
*Assistant Examiner* — Justin Rephann
(74) *Attorney, Agent, or Firm* — Cherskov Flaynik & Gurda, LLC

(57) ABSTRACT

The invention provides a door system comprising a door leaf having a first horizontally disposed edge and a second horizontally disposed edge inferior to the first horizontally disposed edge; a rod-less cylinder in communication with the first horizontally disposed edge; and a cam surface formed with the second horizontally disposed edge to limit the door to a single plane of movement relative to an opening of an enclosure defining a door jamb.

11 Claims, 17 Drawing Sheets

FIG. 9A
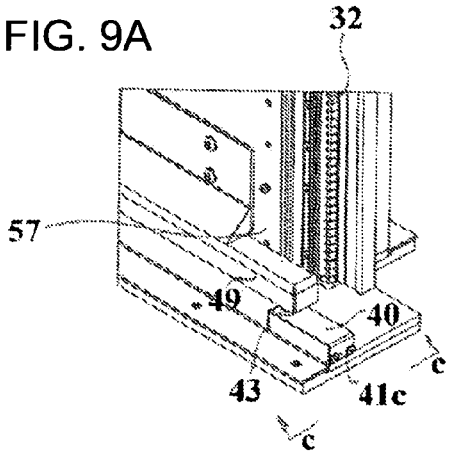
FIG. 9B
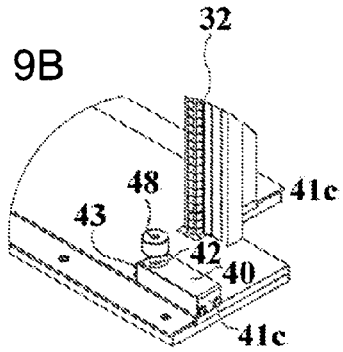
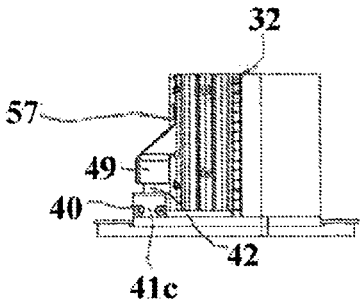
FIG. 9C
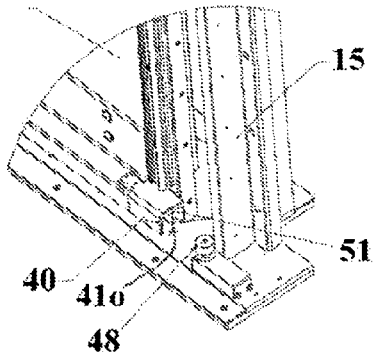
FIG. 9D

Inside Enclosure
Clear Opening
Doors Opened
12
52
12
12i
52i
12ii
52ii
12iii
34ii
Outside Enclosure
15iii
17iii 30
Doors Closed
12
12

34
32
Seal Extrusion

Finger Style Seal
Pneumatic Actuator
53
Seal Retainer
Receiver Extrusion
51

Caliper Style Seal 15
60
62
62
64

MULTISEAL DOOR, METHOD FOR SEALING AN ENCLOSURE

PRIORITY CLAIM

This application claims the benefits of U.S. Provisional Patent Application No. 61/179,662 filed on May 19, 2009.

BACKGROUND OF THE INVENTION

1. Field of the Invention

This invention relates to a multiseal door and a method for sealing an enclosure, and more particularly, this invention relates to a shielded door having seals actuating through a plurality of planes and a method for sealing an enclosure using a substrate having seals actuating through a plurality of planes.

2. Background of the Invention

Imaging systems, particularly medical imaging systems, require pristine environments. Otherwise, background emissions will create artifacts on images that will confound diagnosis.

Offending radio frequency (RF) emissions occurs at all wavelengths. If magnetic resonance imaging is utilized, then similar wavelengths from ambient environment is considered "noise." Likewise, if radio-lucent imaging is utilized, then gamma radiation required for, say angioplasty, may be considered noise to some other process taking place within the same building. Human contamination by such radiation is also an issue.

MRI enclosures exist to confine magnetic fields while excluding electromagnetic frequencies which otherwise comprise MRI images. These enclosures include a continuous webbing of a conductive material (such as copper) to provide an enclave free from EMF emanating from nearby radio stations, mobile phones, electric motors, microwaves, and other devices.

Windows and doorways to MRI enclosures must be similarly shielded. While windows are static installments, doors are more problematic.

A need exists in the art for a door to maintain an emf-free atmosphere to an MRI enclosure, or to an enclosure utilizing MRI. A need also exists for a method for establishing an emf-free atmosphere in an enclosure.

SUMMARY OF INVENTION

An object of the invention is to provide a shielded door and a method for assuring a desired emf status of an enclosure that overcomes many of the disadvantages of the prior art.

Another object of the invention is to provide a door to an enclosure in which medical imaging occurs. A feature of the invention is that the door actuates emf shields along a plurality of planes relative to the plane of the door. An advantage of the invention is its lack of complexity.

Yet another objective of this invention is to provide a shielded door system that can also be used for radiation shielding when RF shielding is not required. The door design and operation lend itself to multi-modality shielding applications.

Another objective of this invention is to provide a shielded door system that can also be used with magnetic shielding for containing magnetic fields within the MRI room area while still providing RF/EMI shielding for the MRI.

Still another object of the invention is to provide a single action MRI/radiation enclosure door system. A feature of the invention is a substantially completely encapsulated header and footing configurations of the jamb of the door. An advantage of the invention is that the door does not move outside of its sliding plane during its actuation.

Yet another object of the present invention is to provide an MRI/radiation enclosure door adaptable to receive sounding-dampening substrate such as acoustical paneling. A feature of the invention is its dual framing configuration. An advantage of the invention is that the duel framing configuration allows addition of acoustic material to all peripheral regions of the door so as to substantially contact the jamb of the door.

Briefly, the invention provides a door system comprising a door leaf having a first horizontally disposed edge and a second horizontally disposed edge inferior to the first horizontally disposed edge; a rod-less cylinder in communication with the first horizontally disposed edge; and a cam surface formed with the second horizontally disposed edge to limit the door to a single plane of movement relative to an opening of an enclosure defining a door jamb.

BRIEF DESCRIPTION OF DRAWING

The invention together with the above and other objects and advantages will be best understood from the following detailed description of the preferred embodiment of the invention shown in the accompanying drawings, wherein:

FIGS. 9A-D are detailed views of the door-to-floor engagement mechanism, in accordance with features of the present invention;

DETAILED DESCRIPTION OF THE INVENTION

Figure 1:
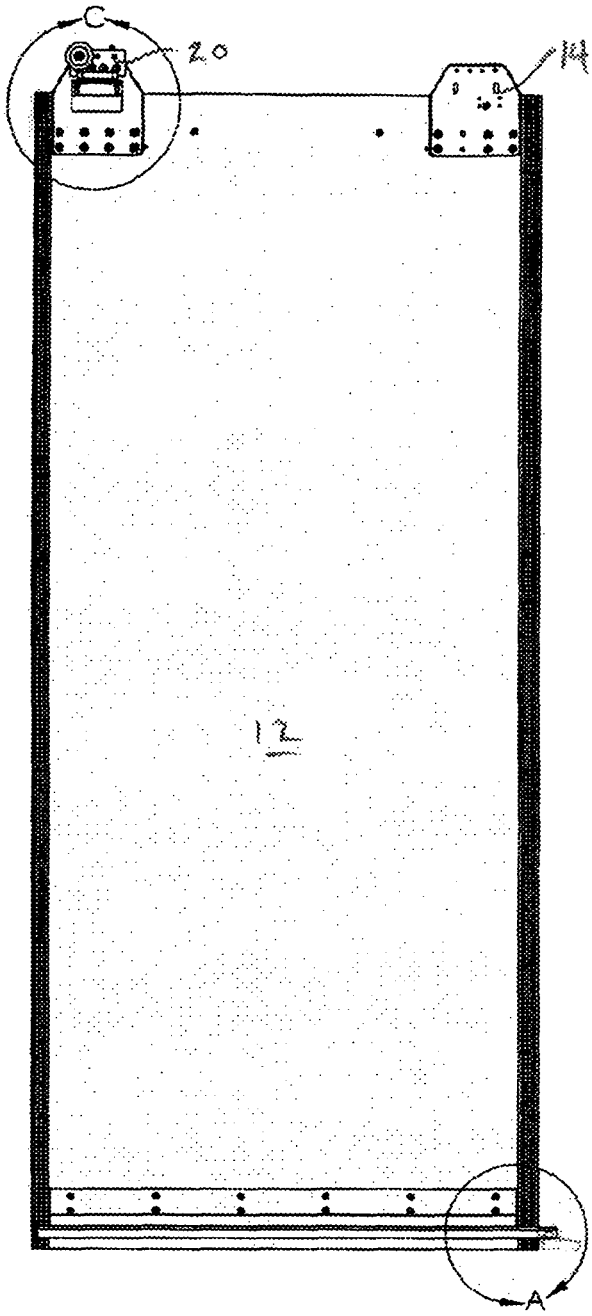
FIG. 1 is an elevational view of a shielded door, in accordance with features of the present invention.

The foregoing summary, as well as the following detailed description of certain embodiments of the present invention, will be better understood when read in conjunction with the appended drawings.

To the extent that the figures illustrate diagrams of the functional blocks of various embodiments, the functional blocks are not necessarily indicative of the division between hardware circuitry. Thus, for example, one or more of the functional blocks (e.g. processors or memories) may be implemented in a single piece of hardware (e.g. a general purpose signal processor or a block of random access memory, hard disk or the like). Similarly, the programs may be stand-alone programs, may be incorporated as subroutines in an operating system, may be functions in an installed software package, and the like. It should be understood that the various embodiments are not limited to the arrangements and instrumentality shown in the drawings.

As used herein, an element or step recited in the singular and preceded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Leaf/Jamb

Engagement Detail

A salient feature of the door leafs of this invention is the plurality of jamb engagement mechanisms. All peripheral regions of the door are adapted to engage with a jamb 30 of an enclosure so as to confer an RF or radiation shield. This shield will prevent ingress and egress of RF or radiation into or out of the enclosure. An embodiment of the invention provides a single action door. "Single Action" is defined herein as the door leaf or leaves traveling in one plane only, that plane parallel to the opening of the enclosure, to engage with the enclosure. No movement of the leaves from that plane occurs in this single action configuration.

In the case of the door used in conjunction with an MRI enclosure, the peripheral edges of the door establish seamless intimate electrical contact with the door jamb in two ways. Horizontally disposed peripheral regions of the door leaf interact with opposing regions of the jamb via a series of bladder-actuated electrical fingers. In operation a bladder causes an electrically conductive substrate to extend outwardly from the door periphery so as to remain within the plane formed by the door leaf. Details of such bladder actuated fingers are found in commonly owned U.S. Pat. No. 6,188,015, the entirety of which is incorporated herein by reference.

Figure 6:
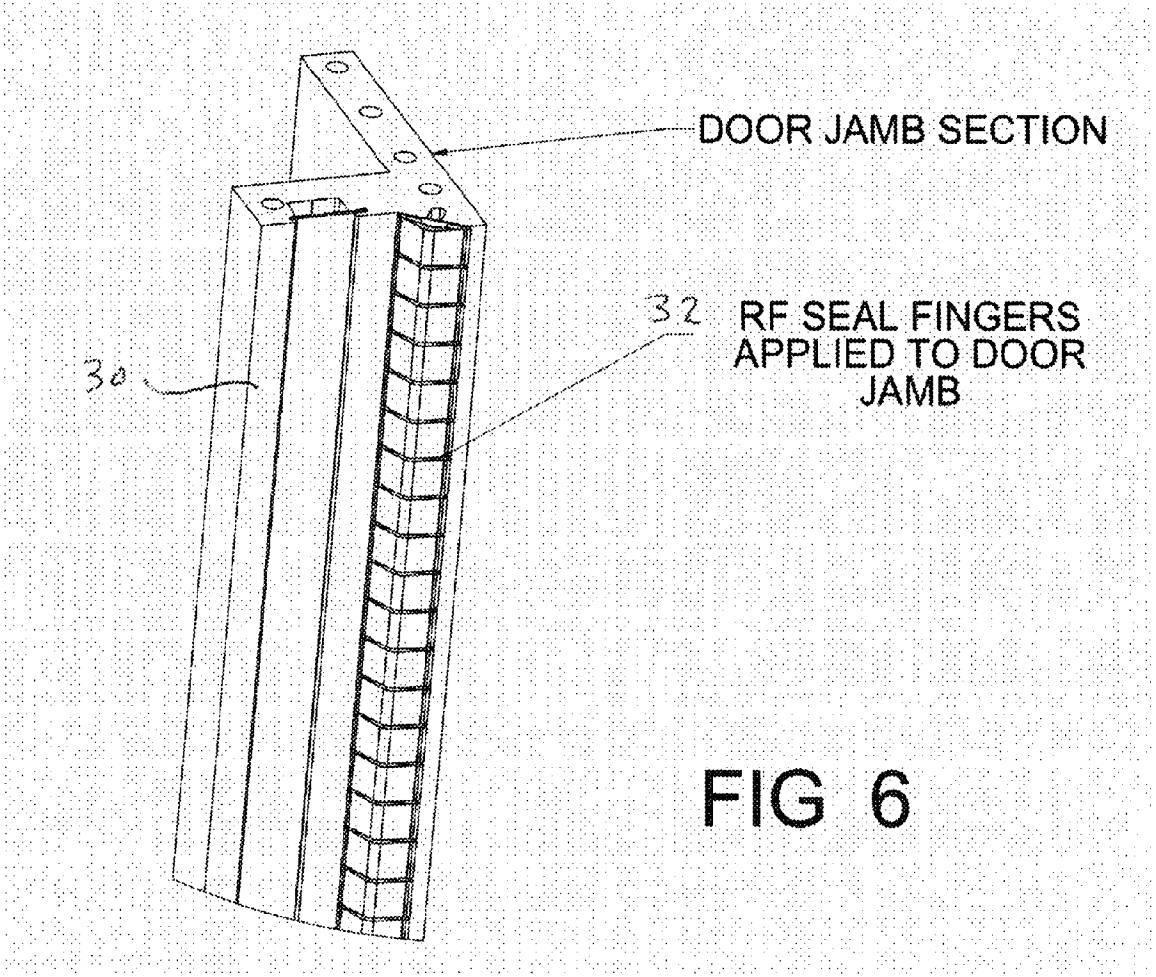
FIG. 6 is a perspective view of vertically extending finger stock door jamb juxtaposed proximal to a similarly extending door jamb; in accordance with features of the present invention.

Vertically disposed regions of the door contact similarly disposed regions of the jamb via a compression interaction. FIG. 6 is a photograph of a vertically disposed jamb region 30. Positioned in close spatial relationship to the region 30 is vertically extending finger stock 32, such that the finger stock 32 is fixedly attached to the vertically extending region 30 of the jamb. The finger stock 32 is reversibly deformable electrically conductive substrate. Its contact with other electrically conductive substrate establishes an electrical continuity which is crucial to maintaining emf shielding.

Figure 7:
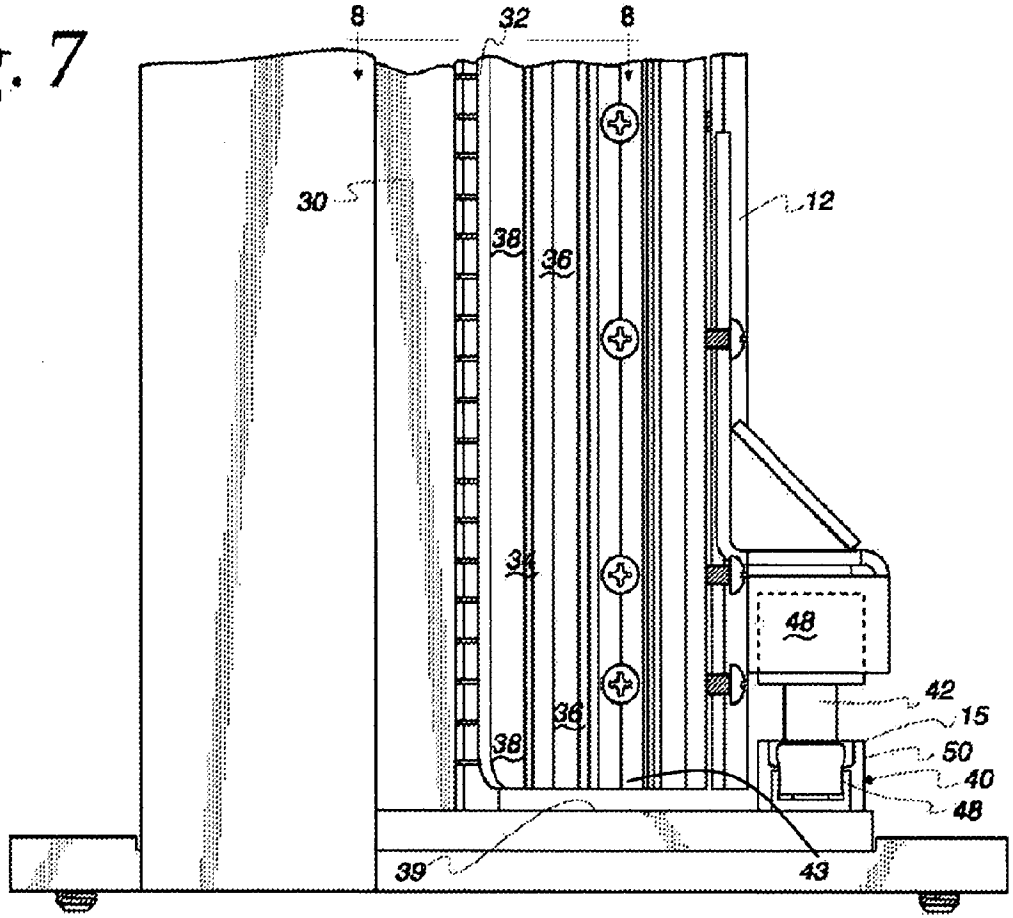
FIG. 7 is a schematic view of a door leaf engaging finger stock attached to a vertically extending portion of a door jamb and the cam follower guide mechanism on the threshold, in accordance with features of the present invention.
Figure 8:
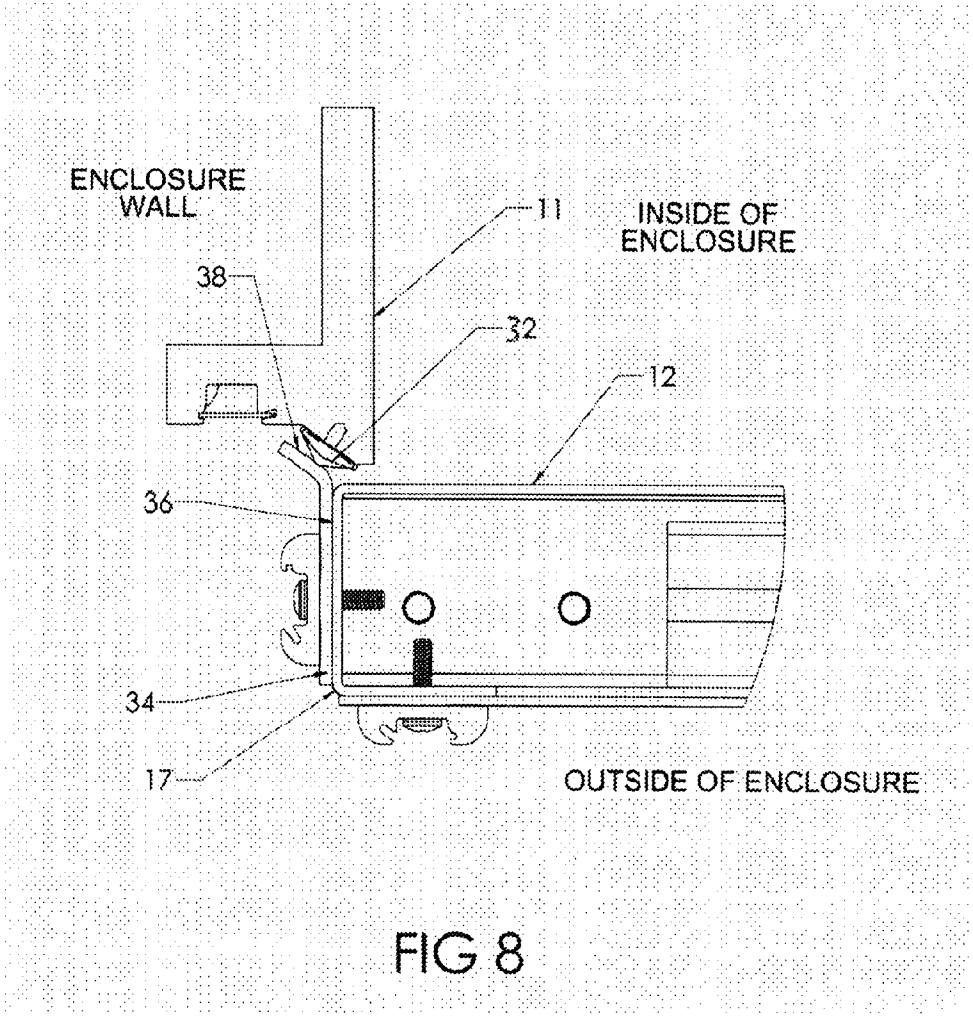
FIG. 8 is a view of FIG. 7 taken along lines 8-8.

FIGS. 7 and 8 show the door leaf 12 compressing, or otherwise deforming the fingerstock between the jamb 30 and the leaf. A feature of this compression configuration is a longitudinally disposed (i.e. parallel to the longitudinal axis of the leaf) compression strip 34 which is attached to the trailing edge 17 of the leaf. This finger compression strip 34 comprises a first surface 36 adapted to substantially contact the periphery of trailing edge 17 of the door.

A second surface 38 of the compression strip 34 is configured at an angle to impart a force against the finger stock and cause the finger stock to slightly flatten when the leaf is positioned in its fully closed position. Thus, the second surface 38 is at an obtuse angle to the first surface so as to automatically urge the fingers to a slightly flattened configuration upon final positioning of the door leaf in its closed position. It is this compression strip 34 configuration which allows for establishing substantially seamless electrical contact between the door and the jamb 30, without the door leaf deviating from its line of travel. The compression of the finger stock occurs in a direction outside of the plane formed by the door leaf. By illustration, FIG. 8 depicts deformation of the finger stock 32 such that the finger stock is deformed inwardly toward the interior of the enclosure, as depicted by the arrow in the figure. That deformation occurs at an angle $\phi$ from the plane formed by the door leaf 12.

The compression strip 34 is adapted to be in slidable communication with an outwardly facing surface of the door leaf, such that the strip can be moved along a line generally perpendicular to the longitudinal axis of the door leaf prior to being removably fastened to the leaf. This allows for fine tuning of the compression mechanism.

Figures 10A, 10B, 10C, 10D:
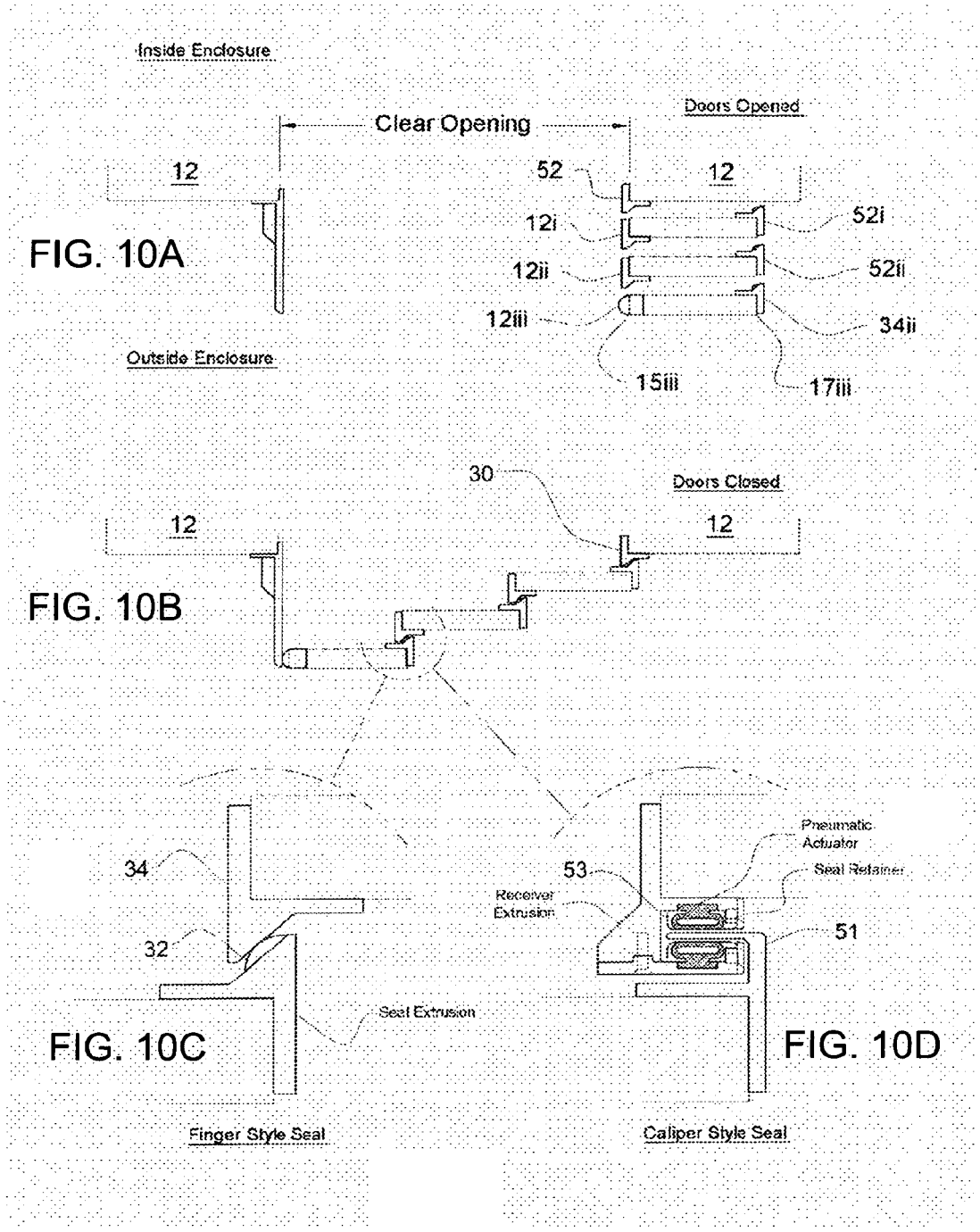
FIG. 10 is a schematic of a stackable leaf embodiment of the instant invention.

Another embodiment of the invention replaces finger stock configuration discussed supra with a caliper seal arrangement. In this instance, a vertically or horizontally disposed edge 51 comprises an electrically-conductive substrate adapted to be reversibly slidably received by an electrically conductive caliper seal 53 positioned on the door jamb 30 opposing the first vertically disposed edge. This caliper arrangement is depicted in FIG. 10D.

Leaf Support

Detail

The following door leaf closing and opening configuration allows for a thin profile compared to door actuating mechanisms which have the door leaf mate with the jamb perpendicularly. One particular multipositioning door system is disclosed in commonly owned U.S. Pat. No. 6,209,264. Such multi-positioning systems add as much as 8-10 inches to the depth of a door closing mechanism. As such, magnet rotation within an enclosure such as an operating room, is often hindered due to space constraints.

Figure 2:
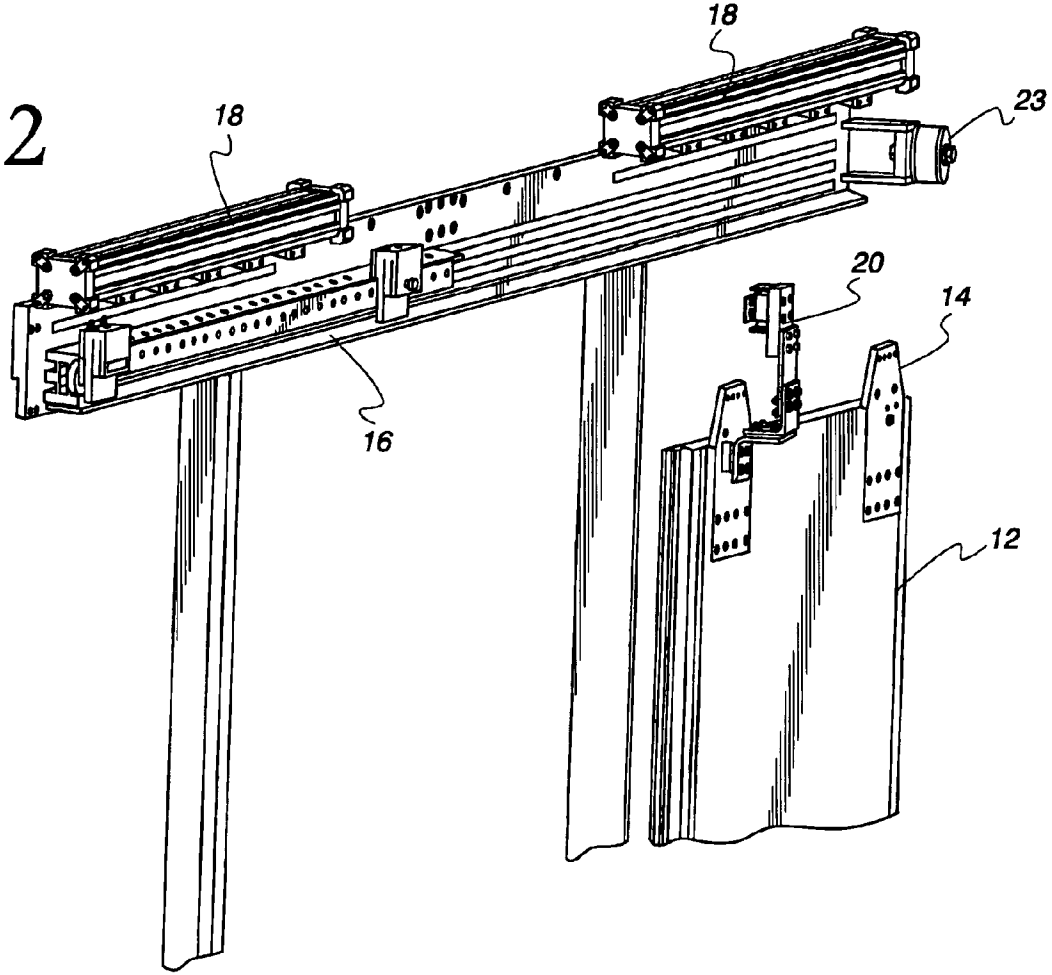
FIG. 2 is a schematic view of the door actuating mechanism in exploded view with the door hanger mechanism, in accordance with features of the present invention.

In one embodiment of the instant invention, a door leaf or plurality of door leafs, is (are) suspended on an overhead track, so as to be in slidable communication with the track. A door leaf 12, shown in isolation in FIG. 1, further comprises one or more brackets 14. As depicted in FIG. 2, the brackets 14 are adapted to slidably engage with an overhead slide 16. The overhead slide 16 is fixedly attached to a stationary structure such as a wall of a building or a door jamb 30.

In an embodiment of the invention wherein opposing door leaves are utilized, the brackets are adapted to allow for a slight toe-in of the opposing medial edges of the door such that the edges are medially rotated within the plane formed by the two doors. This ensures even compression of the door leafs along the entire length of their opposing, leading edges 15 as the opposing leading edges engage each other from the bottom, up. To facilitate coplanar engagement of opposing door leaves, a medially extending protuberance 54 from the leading edge of a lower end of one leaf is adapted to be received by a mating aperture 56 formed in the leading edge of a lower end of the other leaf.

Figure 11:
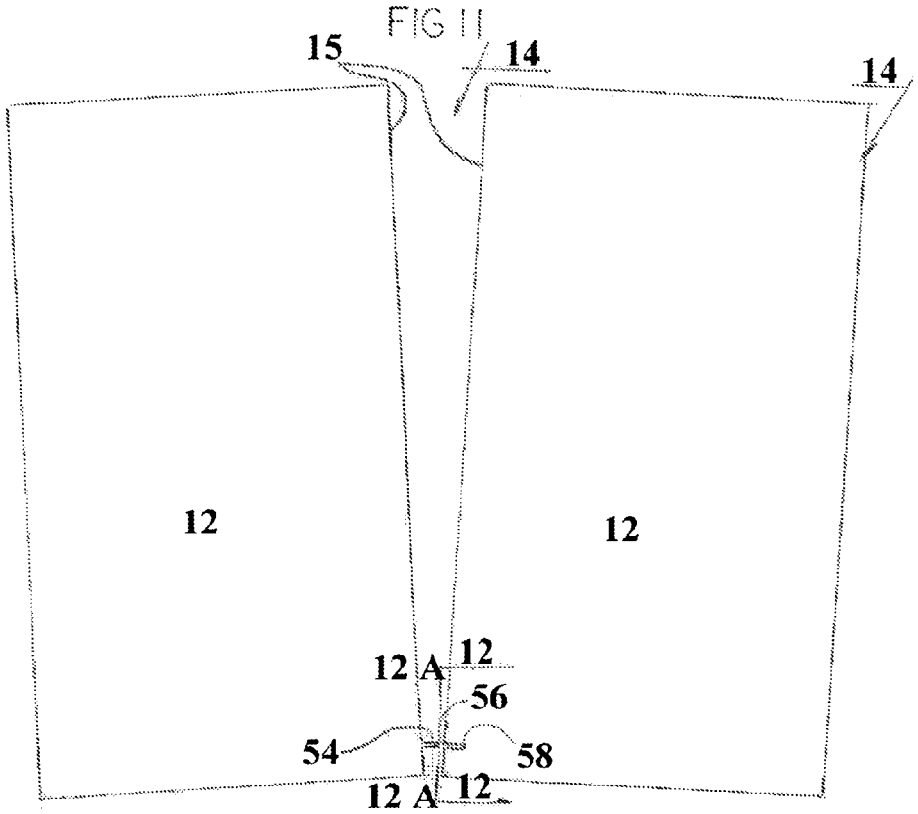
FIG. 11 is a depiction of two opposing door leaves in pre-engagement configuration, in accordance with features of the present invention.

FIG. 11 is an exaggerated view of the leading edge 15 of a first door 12 in toed-in juxtaposition with the leading edge of a second door. The medially extending protuberance 54, positioned from the leading edge of the first door, is matingly received by the aperture 56 positioned at an opposing point of the leading edge of the second door.

Figure 12A:
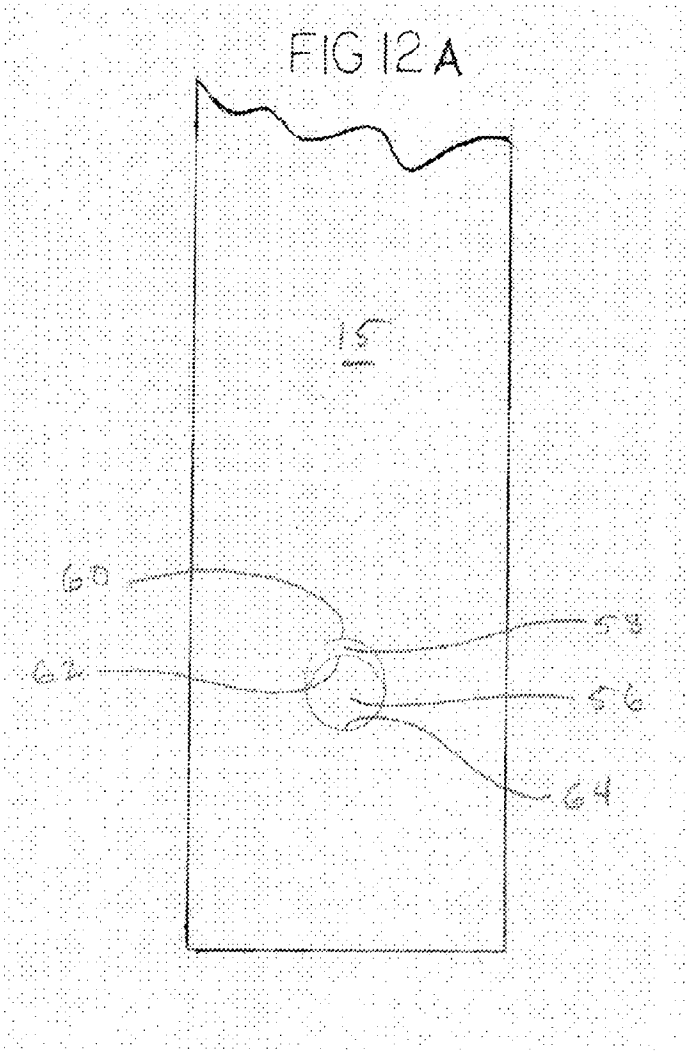
FIG. 12A is a view of FIG. 11 taken along line 12A-12A.

FIG. 12A is a view of FIG. 11 taken along line 12A-12A, and shows an oblong, vertically extending cross section of the aperture 56. This oblong feature further comprises an inwardly—(i.e. laterally) directed ramp 58 originating at the upper periphery 60 of the aperture, and extending laterally and downwardly. A depending lip 62 of the ramp terminates at a point such that the lip of the ramp and the bottom periphery 64 of the aperture define a countersunk aperture (countersunk relative to its respective door edge 15) having a cross section complementary to the cross section of the protuberance. This ramp provides a means for guiding the protuberance into final seating position 58 (located at the closed end of the aperture) as the opposing edges 15 of the doors 12 become fully engaged.

Figure 12B:
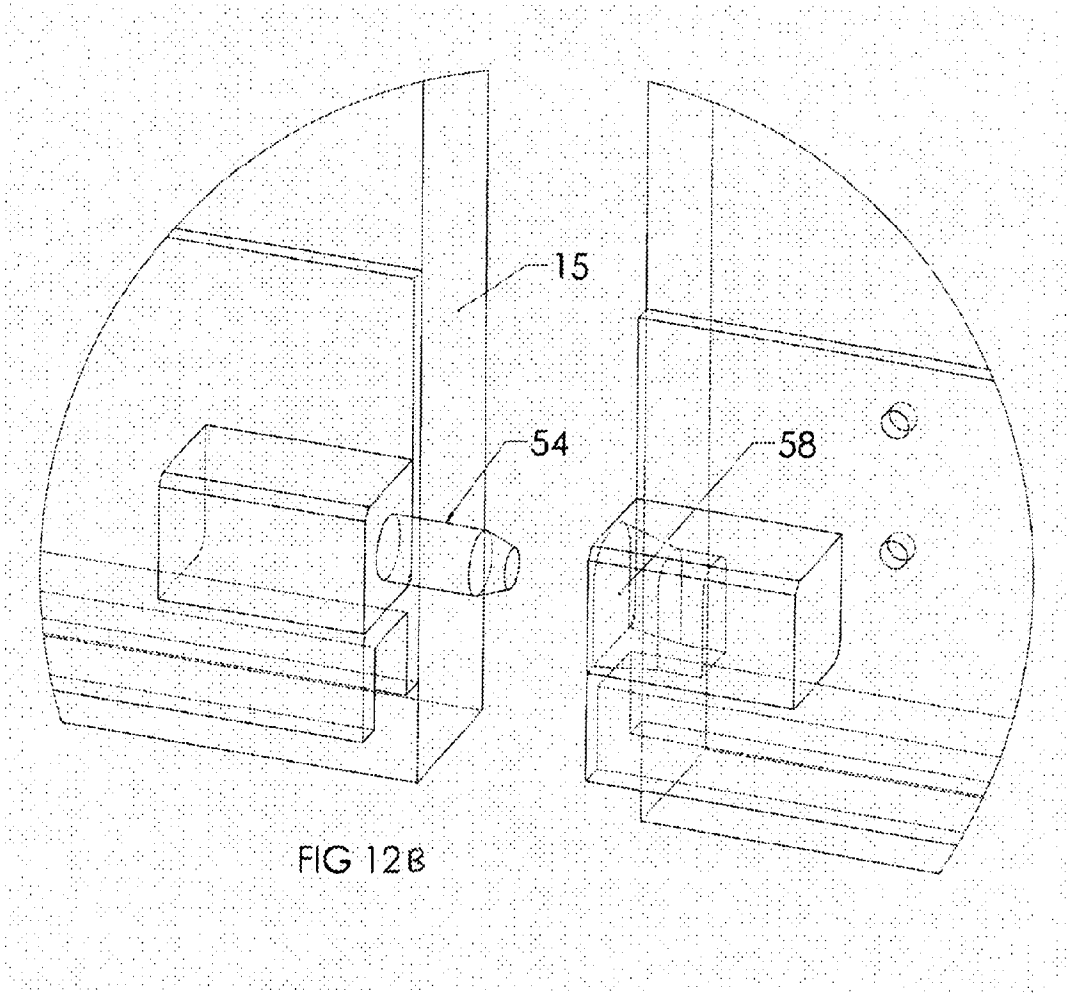
FIG. 12B is a perspective view of an internally-mounted modularized door alignment system; in accordance with features of the present invention.
Figure 12C:
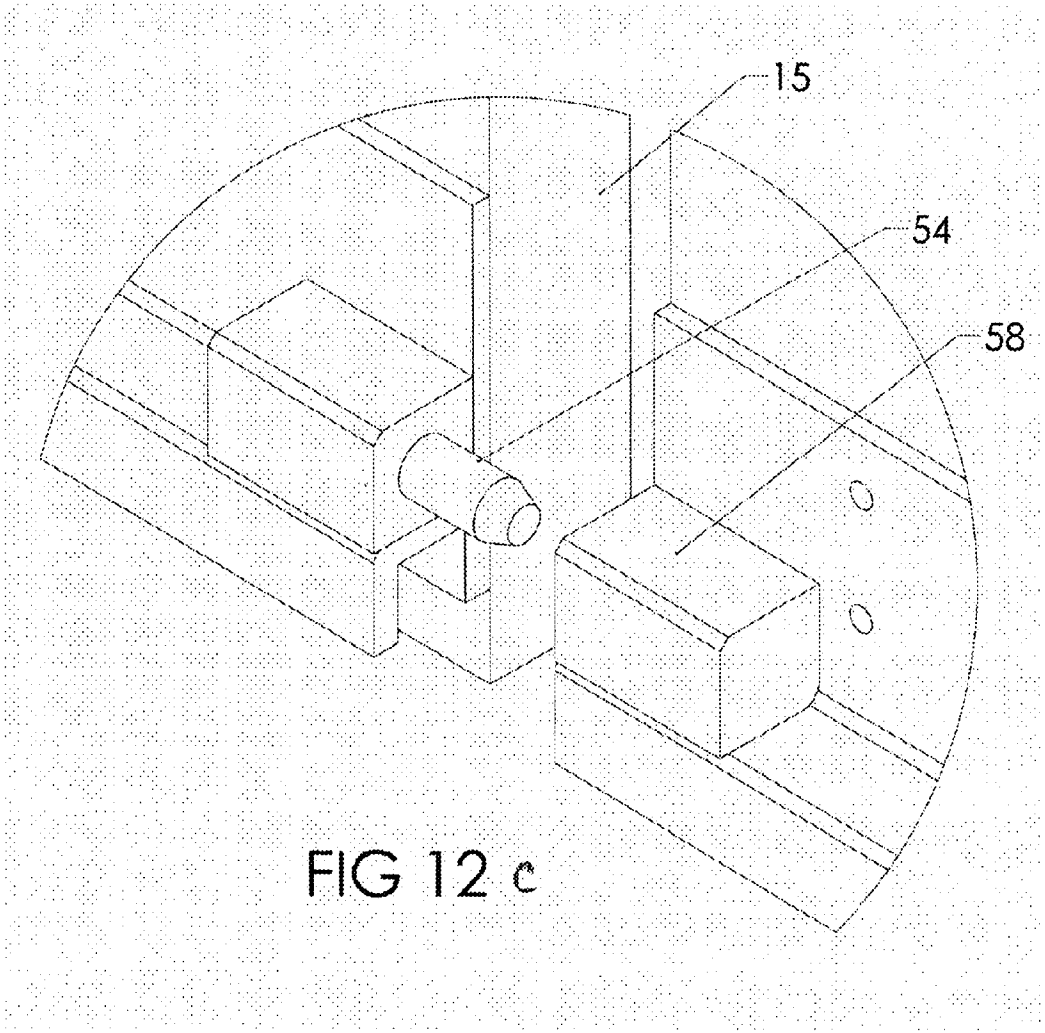
FIG. 12C is a perspective view of an externally mounting door alignment system; in accordance with features of the present invention.

FIGS. 12B and C are alternative means for ensuring opposing leave alignment, wherein the alignment mechanism is modularized so as to be installed internally (FIG. 12B), or externally (FIG. 12C) of the door leaf.

The light weight features of the invented system have resulted in 40 psi being adequate door actuation pressure using only one rod-less cylinder. Normal operating pressures range from about 80 to 100 psi. These pressures, on average from 40 psi to 100 psi, assure sufficient compression of finger stock 32 of the leading edge of one door leaf against the leading edge of an opposing door leaf.

A rod-less cylinder 18 is positioned in close spatial relationship to the overhead slide 16. In one embodiment, the rod-less cylinder 18 is positioned superior to the slide. A myriad of rod-less cylinders are commercially available, such as from Origa, of Glendale Heights, Ill., and Noblesville, Ind. As discussed supra, a plurality of cylinders can be utilized, and in the case of an opposing door leaf configuration, a cylinder is positioned such as to be above the door leafs when the doors are in an open configuration.

Figure 3:
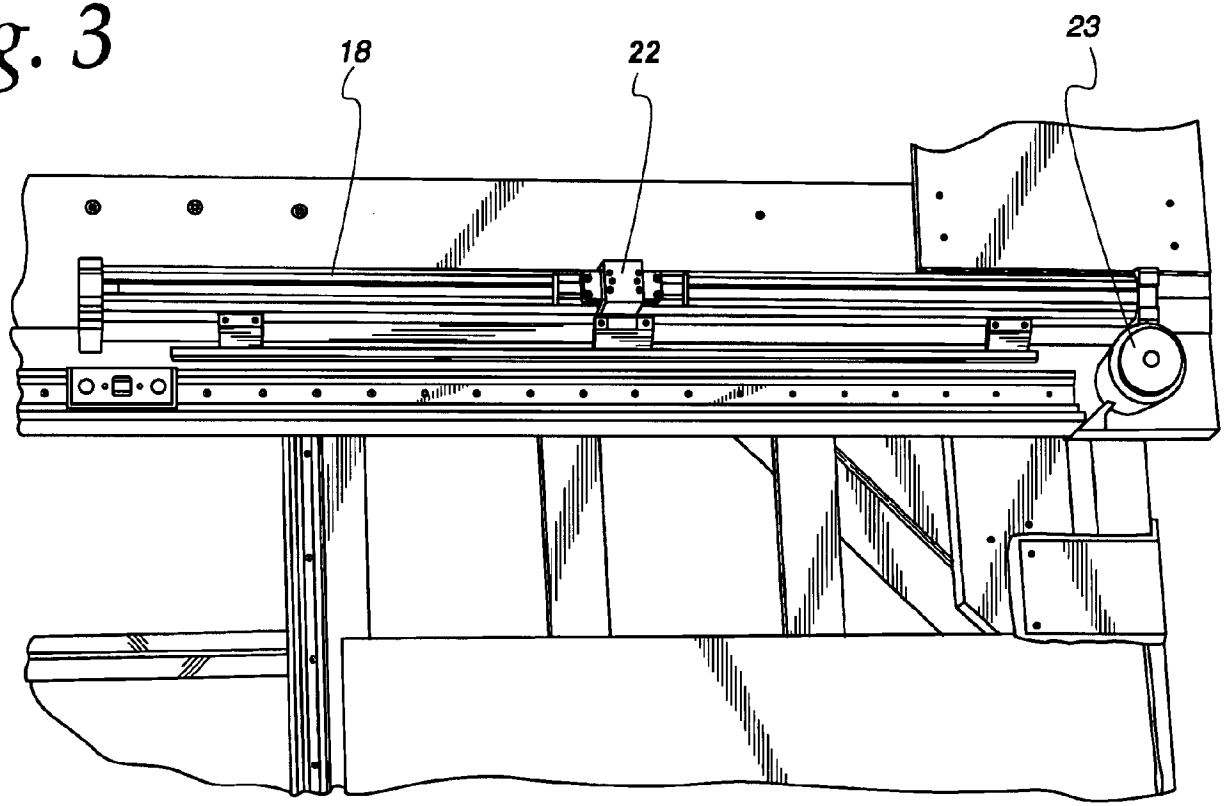
FIG. 3 is a photograph of a rod-less cylinder in accordance with features of the present invention.

A cylinder engaging arm 20 extends upwardly from one of the aforementioned brackets 14 so as to attach to a slidable carriage 22 defined by the rod-less cylinder 18. FIG. 3 is a photograph showing the slidable carriage 22 longitudinally disposed along the rod-less cylinder 18.

Laterally disposed from each end of the slide 16 is a wheel 23 in rotatable communication with the same door jamb or building wall to which the slide is attached. The wheels 23 matingly engage with a continuous belt 24 such that the belt is disposed horizontally so as to define a first longitudinally extending region 26 intermediate the wheels, and a second longitudinally extending region 28 also intermediate the wheels. The second longitudinally extending region is positioned inferior to the first longitudinally extending region. An embodiment of the invention utilizes a smooth pulley versus a toothed wheel for the wheel 23. The smoothed pulley provides a means for fine adjustment of the door opening and closure mechanism by eliminating the fixed increment positioning associated with toothed wheel arrangements. As such, the utilization of two smooth pulleys 23 in a door actuating mechanism relegates the number of fixed belt points to two (each of the two representing the connection point of the belt to the cylinder engaging arm).

Preferably, the actuating belt 24 defines ridges or teeth extending generally perpendicularly to the longitudinal axis of the belt. Surprisingly and unexpectedly, the inventors found that the teeth provide additional surface area to assure nonslippage of the belt when the belt is engaged in the belt gripping means of the cylinder engaging arm 20.

Figure 4:
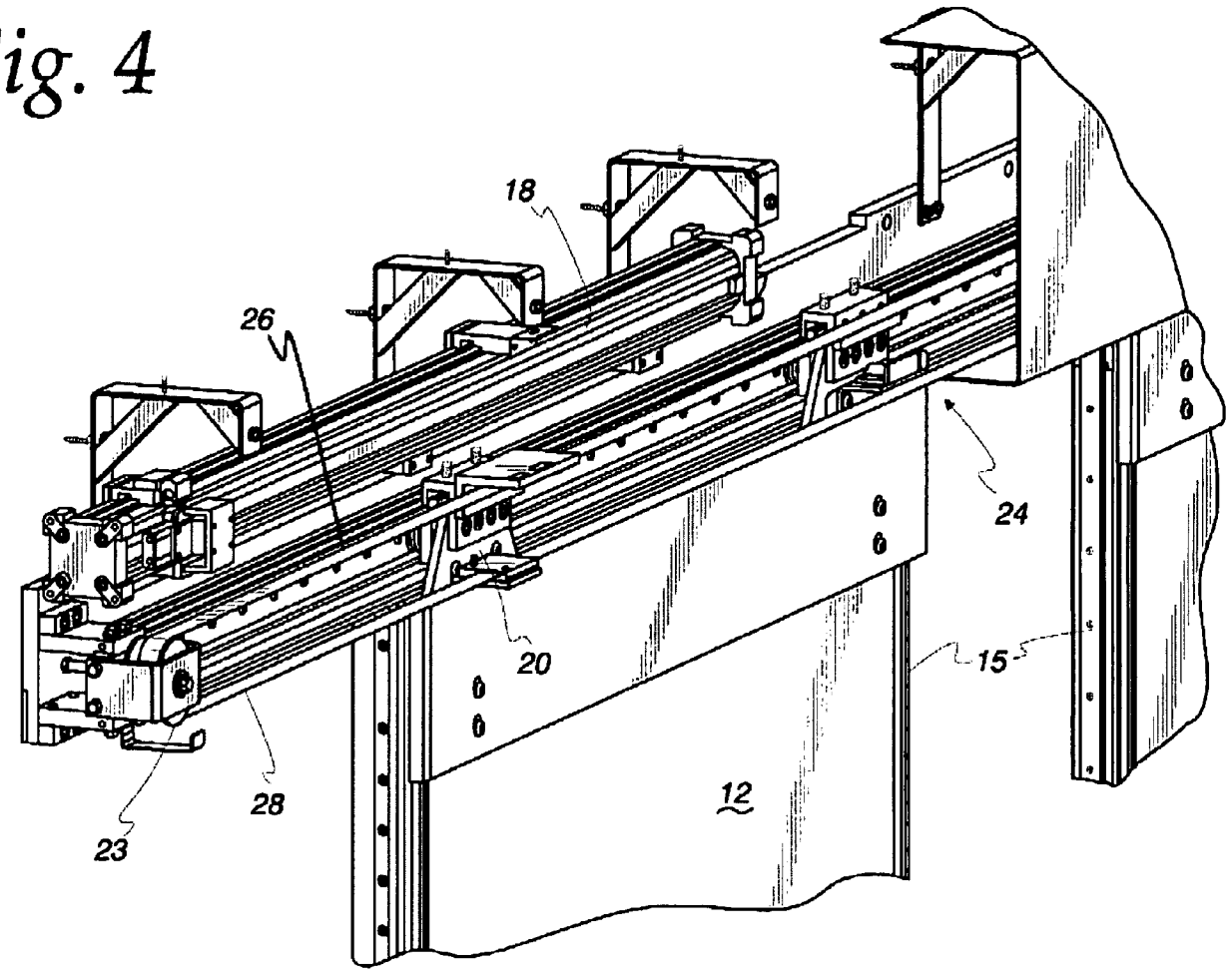
FIG. 4 is a perspective view of a door leaf in communication with a rod-less cylinder via an actuating belt; in accordance with features of the present invention.
Figure 5:
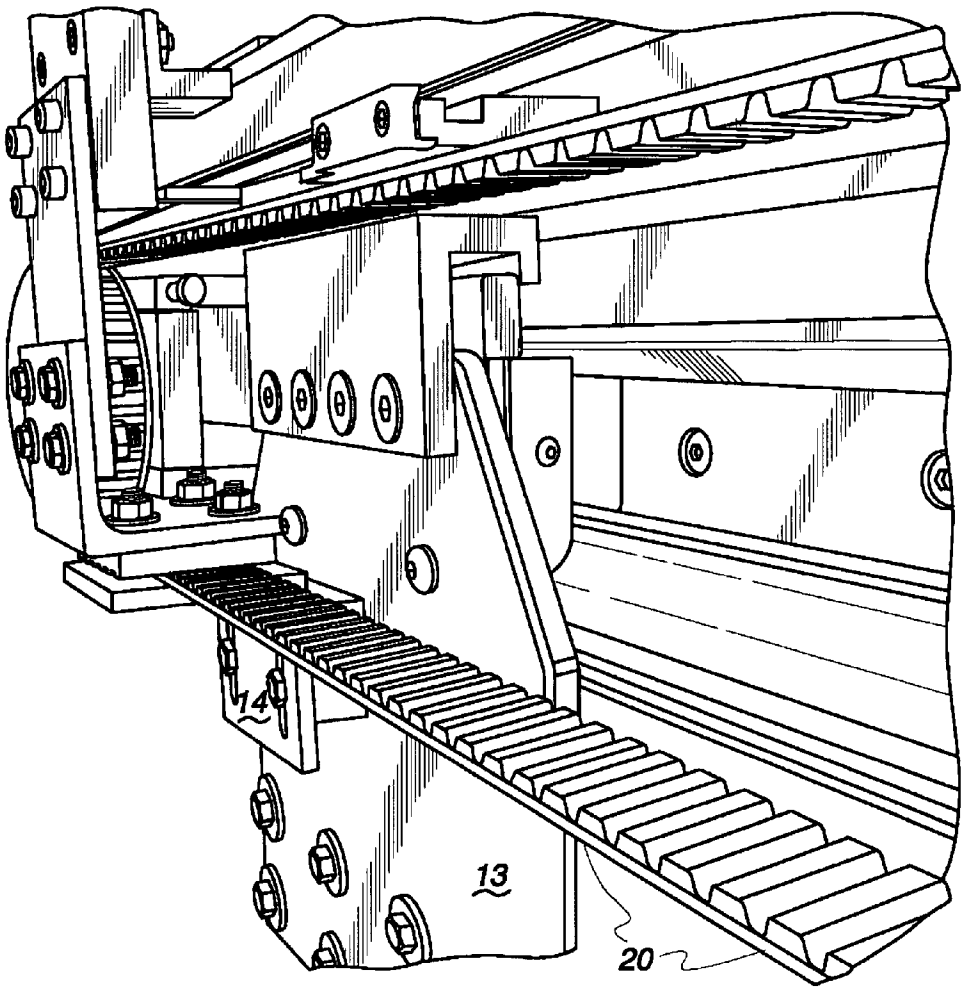
FIG. 5 is an expanded view of a rod-less cylinder in communication with a door actuating belt, in accordance with features of the present invention.

As depicted in FIG. 4, fixedly attached to a first longitudinally extending region of the belt is the cylinder engaging arm 20. In an embodiment comprising two opposing door leafs, the first longitudinally extending region 26 of the belt is fixedly attached to the cylinder engaging arm 20 of the first leaf 12 while the second longitudinally extending region 28 is fixedly attached to the respective brackets of the second leaf 13. (See FIG. 5.) As such, in operation, when the cylinder is actuated along its longitudinal axis, the opposing edges of the leafs move toward or away from each other in unison.

Another salient feature of the present invention is that a depending edge 15 of the door leaf is adapted to establish a radiation proof seal with a continuously smooth threshold 39 without the door leaf deviating from its line of travel. In the embodiment depicted in FIG. 7, the aforementioned line of travel extends perpendicularly to the plane of the figure. A trackless threshold guide 40 allows for lateral movement of the door leaf 12 but with substantially little yawing of the leaf from the line of travel.

As more fully depicted in FIG. 9A, the guide 40 is generally stationary and comprises a first end 41 and a second end 43. FIGS. 9A-C show a closed first end 41*c*, while FIG. 9D shows an open first end 41*o*. The guide further comprises an upwardly directed spindle 42 terminating in a roller bearing 48. The roller bearing 48 is in rotatable communication with the spindle.

An exterior surface 57 of the door in close spatial relationship to the bottom periphery of the door comprises a channel 49, positioned as an inverted trough and adapted to slidably receive the roller bearing 48. The channel 49 extends substantially along the entire length of the door. As can be noted in FIG. 9C, the channel 49 further extends medially past the leading edge of the door so as to assure complete clearance of the door from the door jamb 30 periphery when the door is fully opened.

FIG. 9D provides an embodiment of the cam follower with an open end 41*o*. The opposing, vertically disposed interior surfaces 51 of the cam follower 49 are angled inwardly from the mouth of the open end 41*o* toward the longitudinal axis of the cam follower to facilitate alignment of the roller bearing 48 with the cam follower when the channel is disengaged from the bearing (which disengagement is seen occurring when the door is fully opened and laterally disposed from the jamb.

In operation, the depending region of the door 12 is confined to the line of travel conferred by the channel as the channel engages the roller bearing 48 during opening and closing of the door. FIG. 7 is an elevational view and FIG. 9A is a perspective view of the roller bearing 48 nested in the channel 49.

FIG. 9B is a view of the roller bearing with the door removed for clarity. It should be noted that during normal operations, the roller bearing is generally engaged with the channel, no matter if the door is fully closed or fully open. FIG. 9C is a view of FIG. 9A taken along line C-C.

FIG. 10 is a plan view of a plurality of door leafs 12*i*, 12*ii*, 12*iii* in stackable relationship to each other, and positioned at one side only of an open door jamb. This configuration is a substantial deviation from typical systems whereby open doors flank both sides of a door opening. This stackable configuration is particularly relevant in instances of lead shielding, such as in angioplasty cauterization theatres. Because of space constraints in an OR/Angiography suite, there are instances where the space available for a door system is substantially less than the opening desired and the open width requirements for a door system. A "stackable" door system would allow a larger opening to be completely protected by a door system that uses considerably less space when open than door systems currently available for shielding applications As is featured supra, a first length of finger stock 22 is positioned on a vertical edge of a door jamb 30. This fingerstock 32 engages with the fingerstock compression strip 34 disposed along the corner of the trailing 17 or laterally disposed edge of the first door 12*i*, said corner closest to the exterior wall of the enclosure.

The adjacent corner of that edge is covered with a second length 52*i* of fingerstock. This second length is compressed with a compression strip 32*ii* disposed on a trailing edge 17 of a second leaf 12*ii*.

Another salient feature of the invented door system is that all electronic signals are confined to the inside of the enclosure. This is substantially facilitated via an electrical-to-pneumatic-to electrical protocol. This eliminates the need for as many as a dozen pair of filtered electrical wires and is replaced by signal valves and switches in the invented pneumatic switch paradigm. The invented paradigm replaces multiple square feet of shielded surface space (a premium in these environments) with a nominal 1" diameter opening placed in the shield via a waveguide-beyond-cutoff feed through.

The aforementioned paradigm involved the transport of the door, incorporates a soft start valve disposed intermediate a compact regulator and a transport value. Further, the pneumatic switch paradigm as disclosed herein allows for a spring centered to open position valve. This allows for manual actuation of the doors in the event of a power loss. Also, the pressure switch diaphragm inherent in the pneumatic switches utilized are actuated with as little as 0.05 MPa of air pressure.

The signal valve configuration and use of pneumatics for activating the door for both transport and sealing eliminates most, if not all, electrical penetrations into the shielded space. The use of pressure switches, valves and other pneumatic components, integrated with an externally mounted Programmable Logic Controller (PLC) allows for precise control of the door system and seamless integration with other door systems and life safety systems in the shielded environment and surrounding environments.

Figure 13:
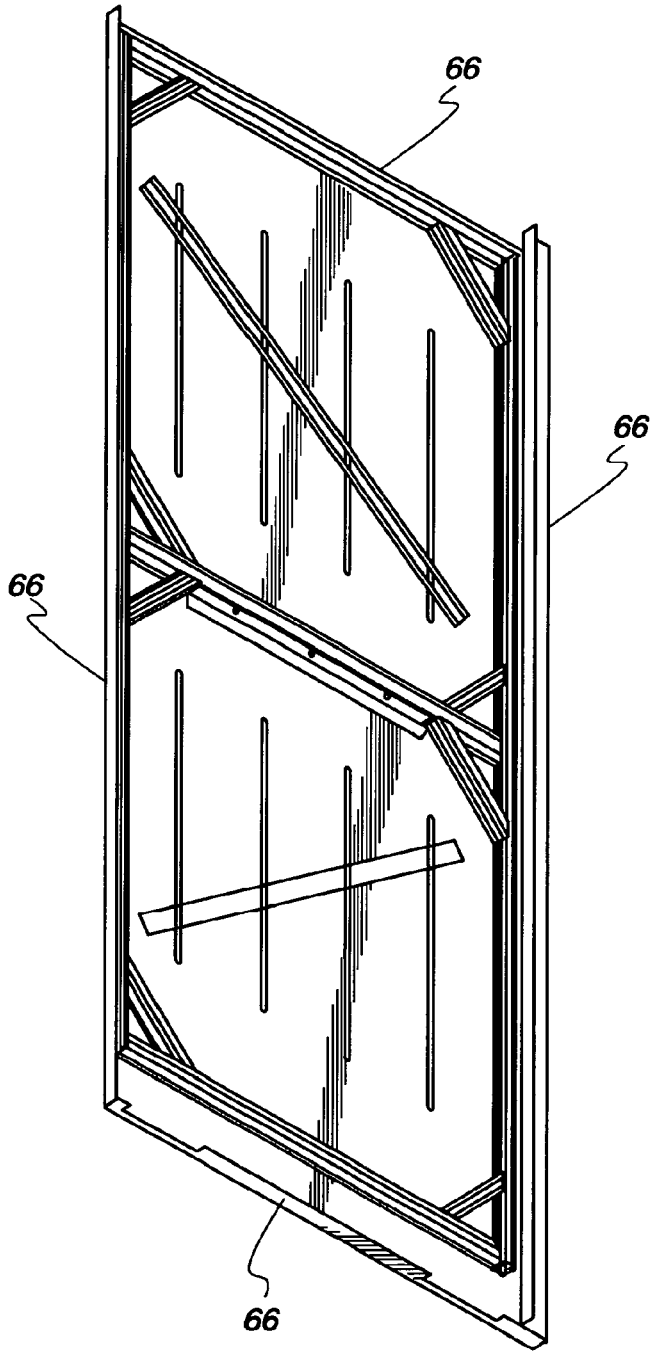
FIG. 13 is a cutaway view of a door leaf, revealing structural components thereof, in accordance with features of the present invention.
Figure 14:
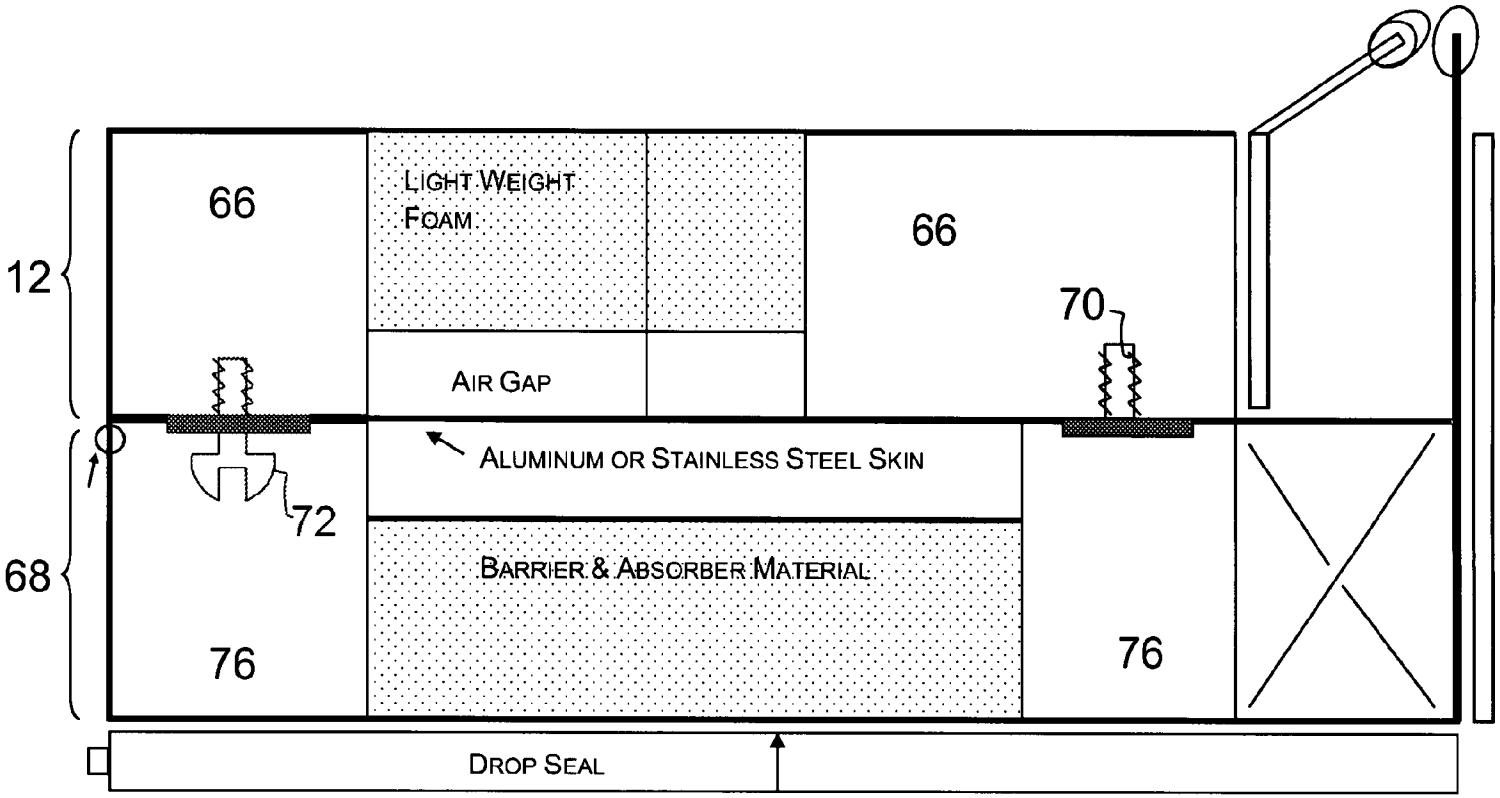
FIG. 14 is a view of FIG. 11 taken along line 14-14.
Figure 15A:
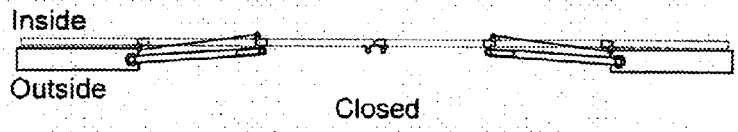
FIG. 15 is a schematic view of a bi-fold shielded door configuration, in accordance with features of the present invention.
Figure 15B:
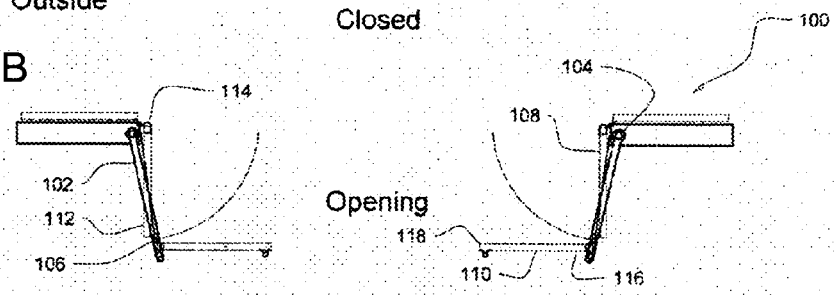
Figure 15C:
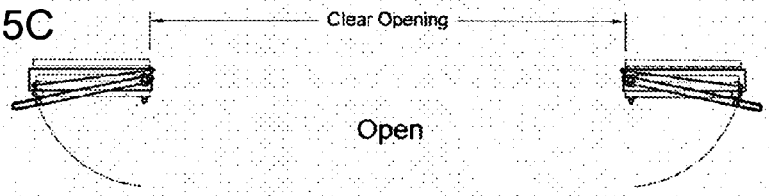
Figure 15D:
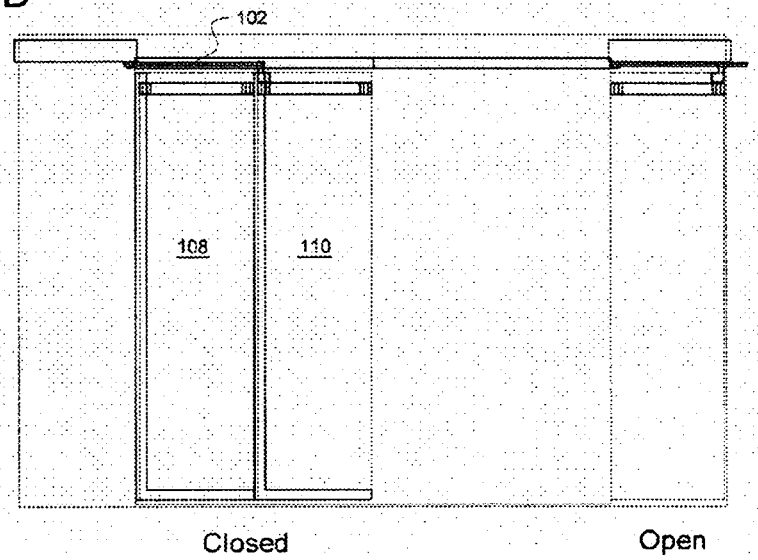

The underlying foundation of each door leaf is depicted in FIG. 13. A plurality of support members 66 define an inner periphery of each leaf and serve as an anchor for the door skins. As illustrated in FIG. 14, these support members are adapted to receive support members for similarly sized substrates such as acoustical panels 68 in a dual framing configuration. The acoustical panels are positioned coplanarly with the door leaf to substantially completely cover the door leaf. In an embodiment of the invention, the panels overhang the periphery of the door leaf a distance to facilitate contact of the overhanging panel to opposing regions of a door jamb and/or the room enclosure when the door is in a closed position.

A variety of fastening means are suitable to reversibly attach the acoustical panels to the door leaves, including but not limited to nut-bolt combinations, bolt-threaded aperture combinations, and combinations thereof. In one embodiment of the invention a region of the door structural member 66 defines a threaded aperture 70 adapted to receive a bolt 72 in a male-female configuration. A proximal end of the bolt is in rotatable communication with a structural member 76 of the acoustical pane 68. Optionally, a dampening means 74 is positioned intermediate the leaf structural member 66 and the acoustical panel structural member 76, a suitable damping means included, but not limited to, a reversibly deformable substrate with regions defining transverse apertures adapted to slidably receive the bolt 72, or a plurality of bolts along longitudinally extending regions of the structural members. These include washers, grommets, elastomeric webbing configured as strips or sheets, or similar substrate.

FIG. 15 is an embodiment of the invention featuring bi-folding door leaves 100 of an MRI enclosure. A salient feature of this embodiment is that when the leaves are completely stowed in a folded configuration (FIG. 15 C), the leaves are completely removed from the periphery of the door jamb. This feature is enabled by the anchoring of a first elongated substrate 102 such as a rod to the outside surface of the enclosure such that a proximal end 104 of the substrate 102 is in rotatable communication with the surface. A distal portion 106 of the rod is in rotatable communication with a first edge 112 of a first bi-fold leaf 108 such that the rod serves as a rotary arm. A second edge 114 of the first bi-fold leaf remains free.

A second bi-fold leaf 110 is positioned distal from the first edge of the first bi-fold leaf such that a proximal edge 116 of that second leaf is in rotatable communication with the distal end of the rod 12. A distal edge 118 of that second leaf remains free so as to define the leading edge for that bi-fold module. The second bi-fold leaf remains parallel with the plane containing the jamb 30 defining the opening of the enclosure. It should be apparent that the proximal edges of the leaves for this bi-fold configuration are to be construed as the trailing edges such that the finger stock compression discussion (supra) related to single leaf door configurations applies here as well.

It is to be understood that the above description is intended to be illustrative, and not restrictive. For example, the above-described embodiments (and/or aspects thereof) may be used in combination with each other. Specifically, two rod-less cylinders, instead of one, may be used in tandem to open and close opposing door leafs, each of the cylinders positioned on each side of the door opening such that the cylinders reside directly above the door leafs when the leafs are in the open configuration.

In addition, many modifications may be made to adapt a particular situation or material to the teachings of the invention without departing from its scope. While the dimensions and types of materials described herein are intended to define the parameters of the invention, they are by no means limiting, but are instead are exemplary embodiments. Many other embodiments will be apparent to those of ordinary skill in the art upon reviewing the above description.

The invention claimed is:

1. A door system comprising:

a) a first door leaf having a first horizontally disposed edge and a second horizontally disposed edge inferior to the first horizontally disposed edge;

b) a second door leaf that opposes the first door leaf and having a first horizontally disposed edge and a second horizontally disposed edge inferior to the first horizontally disposed edge; wherein the first door leaf and second door leaf oppose each other within the same plane of movement;

c) a modular alignment feature on the exterior surface of the first and second door leaves;

d) a seal system comprising vertically extending finger stock; wherein said finger stock extends only along vertical edges of each of the first door leaf and the second door leaf:

e) a rod-less cylinder in communication with the first horizontally disposed edge of the first and second leaves; and f) a an inverted channel adapted to receive a bearing that is stationary relative to the door leaf, wherein said inverted channel limits the first and second door leaves to a single plane of movement relative to an opening of an enclosure defining a door jamb and wherein said inverted channel is proximal to the second horizontally disposed edge of the first and second leaves.

2. The system as recited in claim 1 wherein each of the first and second door leaves has a first exterior substantially overlaid with acoustical panels.

3. The system as recited in claim 1 wherein the first horizontally disposed edge and the second horizontally disposed edge of each of the first and second door leaves further comprise reversibly extending electrically conductive substrates such that the substrates are adapted to establish continuous electrical contact along opposing surfaces of a jamb of the door leaf.

4. The system as recited in claim 3 wherein the electrically conductive substrates are reversibly extended by expansion of an air bladder.

5. The system as recited in claim 1 wherein each of the first and second door leaves further comprises a first vertically disposed edge and a second vertically disposed edge, wherein the first vertically disposed edge of each of the first and second door leaves oppose one another and wherein the second vertically disposed edge of each of the first and second door leaves opposes their respective door jams, whereby the second vertically disposed edges of each of the first and second door leaves establishes continuous electrical contact along opposing vertically disposed peripheries of each of the first and second door leaves' respective door jambs when each of the first and second door leaves are in a closed position.

6. The system as recited in claim 5 wherein the first vertically disposed edge of each of the first and second door leaves comprises an electrically-conductive substrate adapted to reversibly deform electrically conductive finger stock positioned on the door jamb opposing the first vertically disposed edge.

7. The system as recited in claim 5 wherein the first vertically disposed edge comprises an electrically-conductive substrate adapted to be reversibly slidably received by an electrically conductive caliper seal positioned on the door jamb opposing the first vertically disposed edge.

8. The system as recited in claim 1 further comprising at least one RF shield along each of the first and second horizontally disposed edges of each of the first and second door leaves.

9. The system as recited in claim 8 wherein the at least one RF shield is a bladder-actuated, electrically conductive substrate.

10. The system as recited in claim 1 wherein each of the first and second door leaves further comprise at least one bracket proximal to the first horizontally disposed edge of each of the first and second door leaves and wherein said bracket is in slidable communication with an overhead track.

11. The system of claim 10 wherein the at least one bracket causes the first and second door leaves to become biased towards one another in a toe-in configuration such that the second horizontally disposed edges of each of the first and second door leaves are closer together than the first horizontally disposed edges of each of the first and second door leaves.

* * * * *